US006070343A

United States Patent [19]

Sheldon

[11] Patent Number: 6,070,343

[45] Date of Patent: Jun. 6, 2000

[54] TRAILER-TYPE FLOATING SNOW PLOW

[76] Inventor: David T. Sheldon, P.O. Box 30218, Flagstaff, Ariz. 86003

[21] Appl. No.: 09/232,615

[22] Filed: Jan. 19, 1999

[51] Int. Cl.[7] ..... E01H 5/06; A01B 15/00; A01B 23/00; A01B 31/00

[52] U.S. Cl. ..... 37/267; 37/268; 37/271; 37/279; 172/684.5

[58] Field of Search ..... 37/264, 266, 267, 37/268, 270, 279, 271; 172/677, 684.5; 16/30

[56] References Cited

U.S. PATENT DOCUMENTS

| | | | |
|---|---|---|---|
| Re. 35,700 | 12/1997 | Watson et al. | 37/231 |
| 2,774,609 | 12/1956 | Winger | 16/30 |
| 2,800,679 | 7/1957 | Schultz, Jr. | 16/30 |
| 3,158,205 | 11/1964 | Frager et al. | 172/677 |
| 3,164,914 | 1/1965 | Wilson | 172/677 |
| 4,332,052 | 6/1982 | Remington | 16/30 |
| 4,342,163 | 8/1982 | Hoekstra | 37/231 |
| 4,369,590 | 1/1983 | Miller | 37/231 |
| 4,403,432 | 9/1983 | Biance | 37/235 |
| 4,506,465 | 3/1985 | Johnson | 37/268 |
| 4,620,381 | 11/1986 | Plyler et al. | 37/98 |
| 4,905,387 | 3/1990 | Street | 37/271 |
| 4,991,323 | 2/1991 | Benkler | 37/235 |
| 5,050,322 | 9/1991 | Burkard | 37/270 |
| 5,209,307 | 5/1993 | Hotte | 172/445.2 |
| 5,245,771 | 9/1993 | Walsh | 37/269 |
| 5,251,390 | 10/1993 | Wong | 37/231 |
| 5,265,355 | 11/1993 | Daniels | 37/231 |
| 5,289,880 | 3/1994 | Barto | 172/799.5 |
| 5,394,947 | 3/1995 | Essex et al. | 172/439 |
| 5,485,690 | 1/1996 | MacQueen | 37/271 |
| 5,595,007 | 1/1997 | Biance | 37/368 |
| 5,806,213 | 9/1998 | Doornek et al. | 37/231 |

*Primary Examiner*—Eileen Dunn Lillis
*Assistant Examiner*—Gary S. Harjmann
*Attorney, Agent, or Firm*—Edward L. White

[57] ABSTRACT

An adjustable grading device attaching to a vehicle rear towing hitch having a grading blade for grading or snow removal and integrated wheels for transport.

1 Claim, 4 Drawing Sheets

TRAILER-TYPE FLOATING SNOW PLOW

CROSS REFERENCES TO RELATED APPLICATIONS

None.

BACKGROUND OF THE INVENTION a. Field of the Invention

The invention relates to devices related to devices for the removal and grading of snow, gravel and the like. In particular, the invention relates to devices intended to be removably attached to light utility vehicles, including pickups, suburbans, tahoes, and the like for removal and grading of snow and gravel.

b. Description of the Prior Art

Devices for grading and removing snow are well known. There are two basic types of snowplow devices:

1. Devices intended to be mounted on the front of a vehicle, such as U.S. Pat. No. Re. 35,700 to Watson, et al., for a Removable Snowplow Assembly With Pivotable Lift Stand; and
2. Devices intended to be mounted on the rear of a vehicle such as U.S. Pat. No. 5,595,007 to Biance, for a Trailer-Type Snowplow.

There are advantages and disadvantages to both types of devices. For example, the devices mounted on the front of a vehicle tend to decrease the chances of the vehicle becoming stuck in the snow or gravel. That is because the snow or gravel is moved before the wheels contact the surface. That is, the wheels are rolling on ground that has already been plowed. Further, the front-mounted devices allow a driver of the vehicle to more easily keep an eye on the plowing operation. In addition, the front-mounted devices allow a user to more easily stack or pile-up the material being moved.

Nevertheless, despite their advantages, there are also disadvantages to the front-mounted types of devices. For example, most vehicles do not have attached thereto the necessary hardware for mounting a front-mounted snowplow.

Therefore, there are also a plurality of designs for rear-mounted snowplows. U.S. Pat. No. 5,595,007 to Biance, discloses such a trailer-type snowplow. Biance utilizes a "receiver hitch"—receiver hitch type mounting device. That is, the snowplow mechanism has a male portion adapted to be removably be received within a female portion of a bracket mounted to the vehicle. A pin passes through the male portion of the bracket and the female portion of the snowplow fixing them in relation to one another. The snowplow can easily be removed from t he vehicle by removing the bland sliding the male portion of the snowplow out of the female portion of the bracket. The advantages of the Biance device is that a user can easily remove the snowplow from the vehicle without unsightly and space consuming hardware being left thereon. Prior are devices required a user to leave a mounting bracket permanently attached to the vehicle. This mounting bracket typically detached to the bumper and other points on the vehicle, taking up space and detracting from the appearance of the vehicle.

Another type of rear-mounted snowplow apparatus is disclosed in U.S. Pat. No. 5,265,355 to Daniels. Daniels device is a three-point mounted snowplow. That is, there is an attachment at a center of a rear bumper and on either end of a rear bumper of a vehicle. Daniels discloses a box-type blade device. It has a means for raising and lowering the blade (as did Biance). The device disclosed by Daniels is extremely heavy and relatively expensive to manufacture. The angle of the blade with respect to the rear bumper of the vehicle is fixed in the Daniels device. That is, there is no way to angle the blade so as to move it to one side of the vehicle or another.

Given the currently available and known devices, there is a need for a plow device which is extremely simple and inexpensive to manufacture. There is also a need for a device which can be attached to existing trailer hitches on vehicles. Specifically, there is a need for a snowplow which attaches to standard trailer-towing balls on the bumpers of many vehicles.

SUMMARY OF THE INVENTION

In view of the foregoing disadvantages inherent in the known types of devices for the removal and grading of snow, gravel and the like, it is an object of the invention to provide an apparatus which overcomes the various disadvantages of the prior art.

It is therefore an object of the invention to provide a snowplow which has a connection means capable of being attached to trailer-towing balls on the rear bumper of a vehicle.

It is a further object of the invention to provide a simple means of transporting the plow when a user does not desire for the plow to be in contact with the ground.

It is a also an object of the invention to provide a simple means for adjusting the angle of the blade with respect to the rear bumper of a vehicle.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. Additional benefits and advantages of the present invention will become apparent in those skilled in the art to which the present invention relates from the subsequent description of the preferred embodiment and the appended claims, taken in conjunction with the accompanying drawings. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application which is measured by the claims, nor is it intended to be limiting as to the scope of the invention in any way.

BRIEF DESCRIPTION OF THE DRAWINGS

The invention will be better understood and the objects other than those set forth above will become apparent when consideration is given to the following detailed description thereof. Such description makes reference to the annexed drawings wherein:

FIG. 6 is a bottom view of the same adjustable wheel mechanism shown in FIG. 5.

DETAILED DESCRIPTION OF PREFERRED EMBODIMENTS

Figure 1:
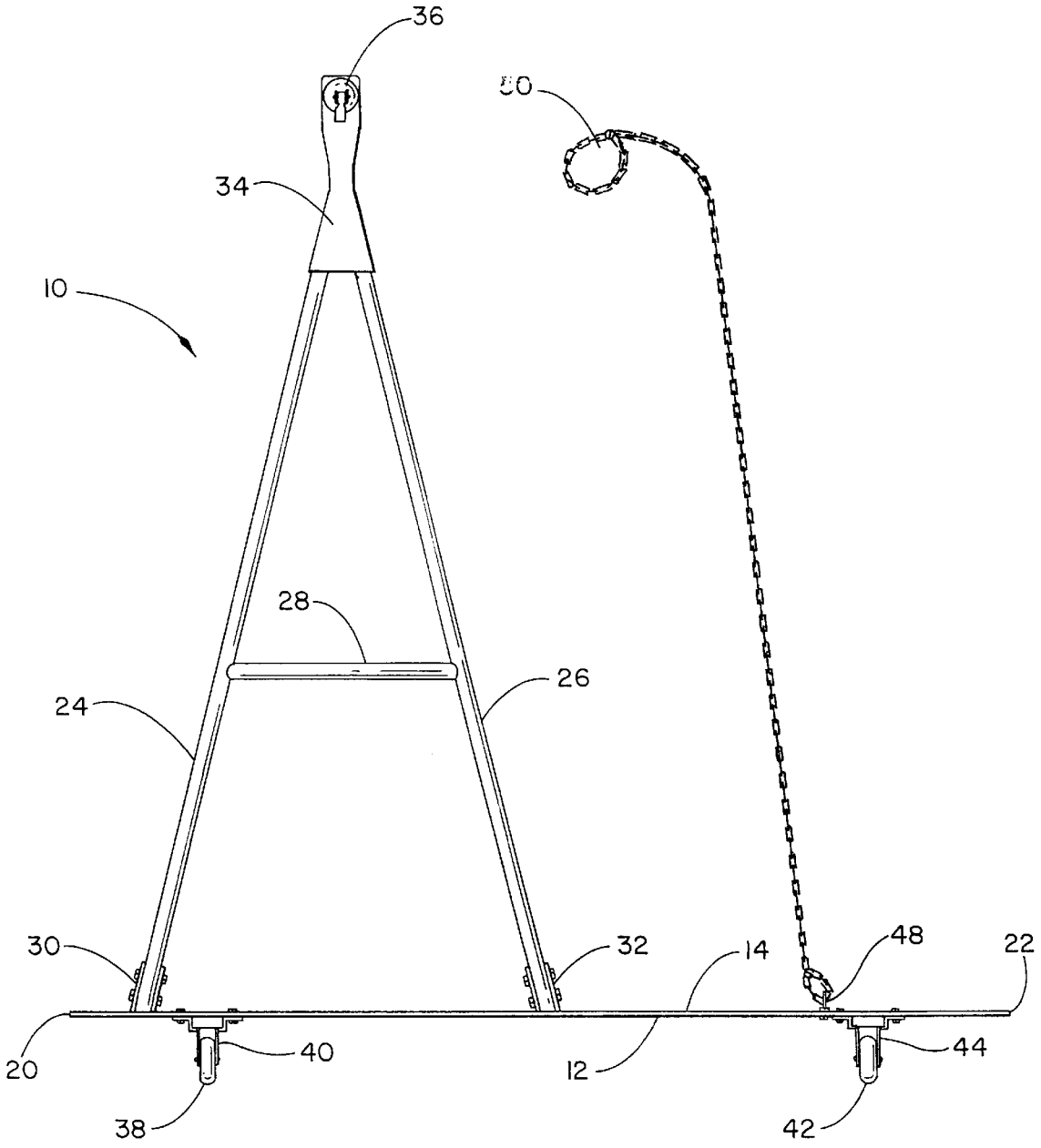
FIG. 1 is a top view of the trailer-type floating snowplow.
Figure 2:
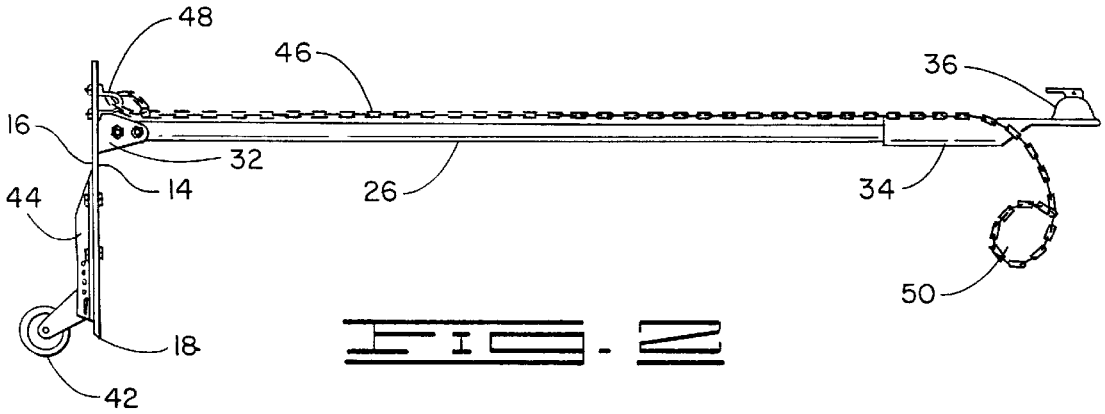
FIG. 2 is a side view of the trailer-type floating snowplow.
Figure 3:
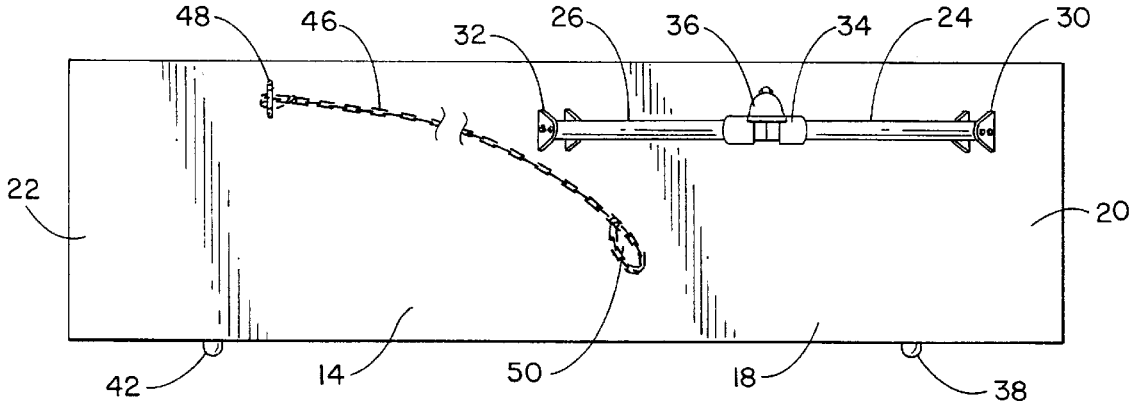
FIG. 3 is a front view of the trailer-type floating snowplow.
Figure 4:
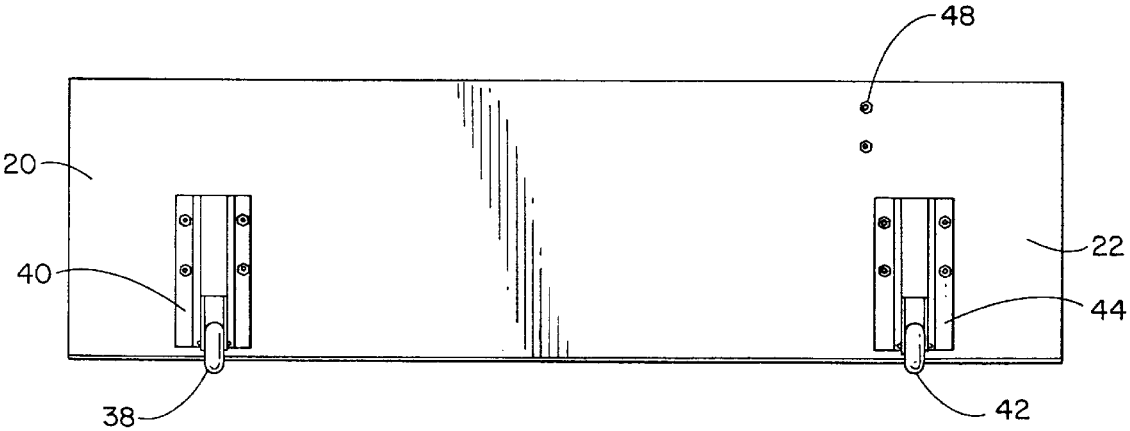
FIG. 4 is a rear view of the trailer-type floating snowplow.

Referring now to the drawings, where like numerals represent like or parts, an apparatus 10 incorporating the principles of the present invention is generally illustrated in the figures. FIG. 1 shows the apparatus 10 in a first embodiment. The embodiment shown if FIG. 1 is the same as the embodiment shown in FIGS. 2 through 7. An alternative embodiment of the invention is shown in FIGS. 8 through 10.

Figure 7:
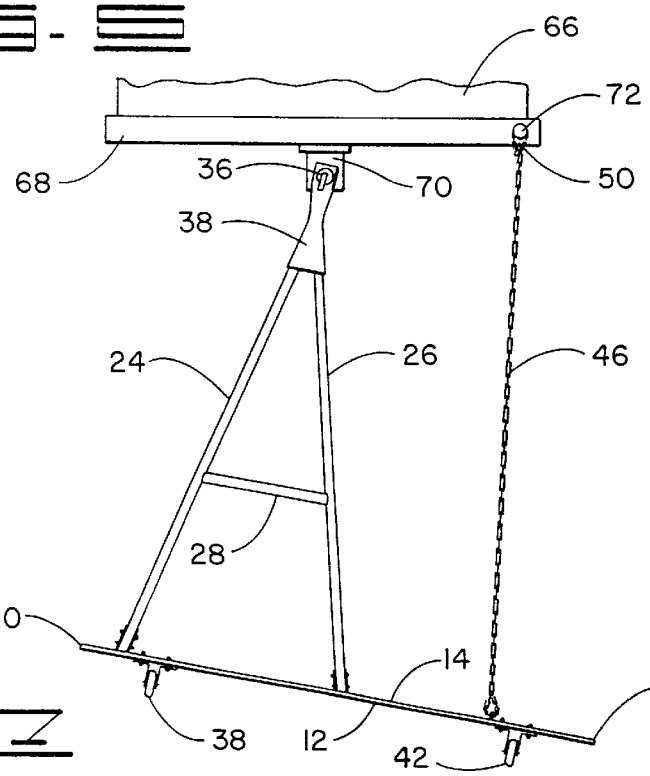
FIG. 7 is a top view of one configuration of the trailer-type floating snowplow attached to a rear bumper of a vehicle.
Figure 8:
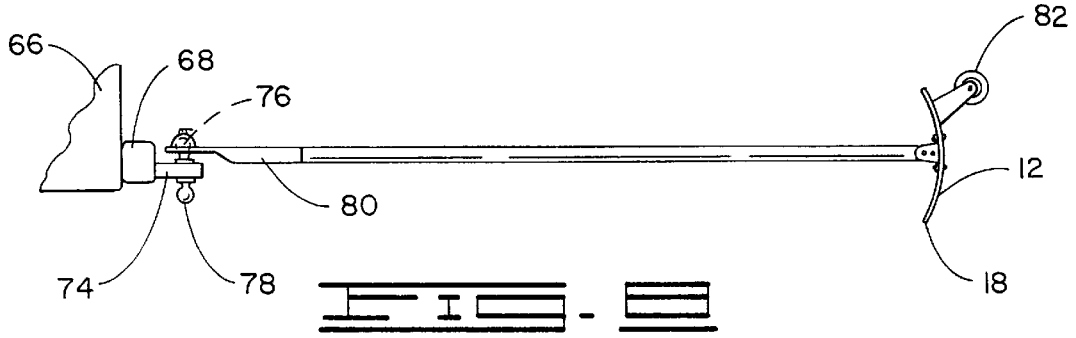
FIG. 8 is a side view of a second embodiment of the trailer-type floating snowplow attached to a vehicle with the scraping surface in contact with the ground.
Figure 9:
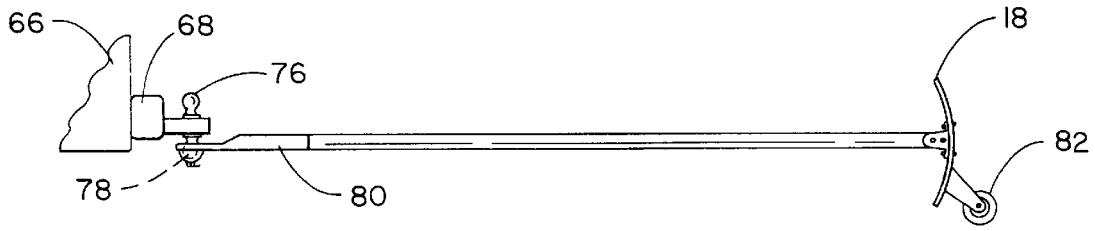
FIG. 9 is a side view of the same embodiment of the trailer-type floating snowplow with the fixed wheels in contact with the ground and the offset hitch plate attached to the lower ball of the reversible hitch.
Figure 10:
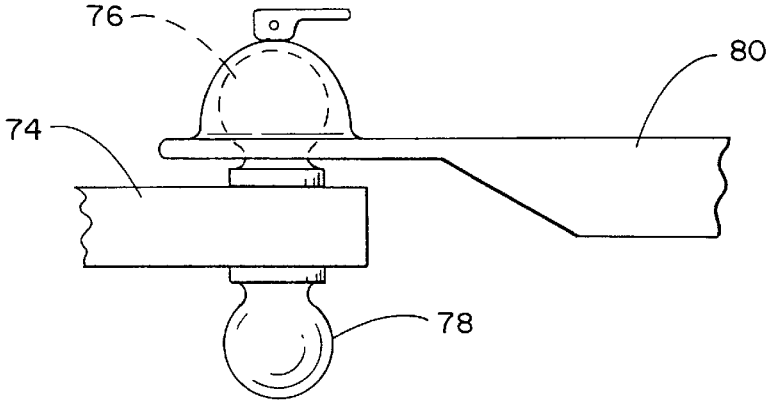
FIG. 10 is a detailed side view, partially in section, of the reversible hitch and offset hitch plate.

The embodiment shown in FIGS. 1 through 7 will be detailed first followed by a description of the embodiment shown in FIGS. 8 through 10.

The trailer-type floating snowplow 10 holds a blade 12 for scraping snow, gravel, and the like. Preferably, the blade is made out of a hardened steel material, which is durable yet tough enough so that not to be brittle. The blade may be either straight or slightly concave with the concave portion facing the vehicle facing behind which it is being towed. As shown in FIGS. 1 through 7, the blade 12 is straight, while the blade 12 is shown as curved in FIGS. 8 and 9. The blade has a front 14 which faces the vehicle behind which it is being towed and a back 16 which faces away from the vehicle. A scraping surface 18 is defined along one of the long edges of the blade 12. A first hitch bar 24 is attached to the blade 12 by a first bar connection means 30 adjacent to a first end 20 of the blade. A second hitch bar 26 is attached to the blade 12 by a second bar connection means 32 at or near a center point between the first end 20 and second end 22 of the blade 12. The first and second hitch bars combined with the blade define a triangular shape. That is, the first and second hitch bars come together at a distal end. A crossbar 28 is disposed between the first and second hitch bars 24 and 26 somewhere between the blade and a point where they come together. The crossbar 28 provides additional stability to the first hitch bar 24 and the second hitch bar 26. At a point where the first hitch bar and the second hitch bar 24 and 26 come together, they are attached to a hitch plate 34. A releasable hitch 36 is also attached to the hitch plate 34. The releasable hitch is one of the commonly commercially available hitch means for engaging a ball-type hitch on a vehicle bumper. A multiplicity of places are available to accomplish this objective, and one skilled in the art would be aware of these types of devices for engaging a ball-type hitch. The releasable hitch 36 is shown attached to a first connection point 70 in FIG. 7. The first connection point 70 is preferably a ball-type hitch attached either directly to a bumper of a vehicle or to a receiver-type apparatus with a removable receiver hitch, and these devices are well known.

Figure 5:
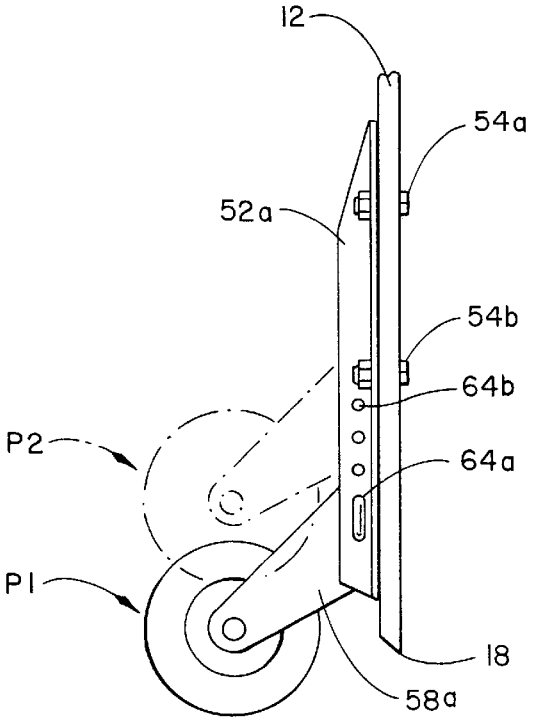
FIG. 5 is a detailed side view of an adjustable wheel mechanism.
Figure 5:
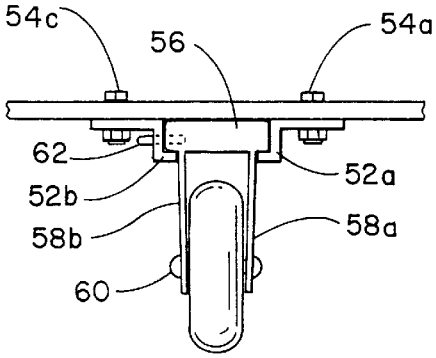

In the first embodiment of the plow as shown in FIGS. 1 through 7, two wheels are attached to the blade adjacent to the scraping surface. The first wheel 38 detaches by means of a first wheel adjustment means 40. Similarly, a second wheel 42 is attached by means of a second wheel adjustment means 44. The attachment of the wheels is shown in detail in FIGS. 5 and 6. FIG. 5 is a side view of the wheel adjusting means 44. For each wheel, two Z-shaped members, 52*a* and 52*b*, are attached to the blade 12 by bolts 54. At least two bolts, 54*a* and 54*b*, are attached to each Z-shaped member 52. In cooperation, the two Z-shaped members for each wheel, 52*a* and 52*b*, define a channel for slidingly receiving a sliding member 56. The sliding member has attached to it two side plates, 58*a* and 58*b*. The side plates, 58*a* and 58*b*, angle downwardly and away from Z-shaped members, 52*a* and 52*b*. An axle 60 passes through the side plates, 58*a* and 58*b*, upon which is mounted a wheel 38 or 42. Adjusting holes 64 are defined through the two Z-shaped members. The adjusting holes 64 are in linear alignment, so that a removable locking pin 62 may pass there through. A corresponding hole defined in the sliding member 56 (hole now shown) so that when the removable locking pen 62 is passed through the adjusting hole 64, it fixes the sliding member 56 into place. FIG. 6 shows the sliding member 56 and the associated side plates 58 and wheels 38 and 42 in a first position, P1, and a second position in outline, P2. In position P1, the removable locking pin 62, is inserted through hole 64*a*. By contract, the sliding member 56 is slid upwardly in the channel defined by the two Z-shaped members, 52*a* and 52*b*, to a second position as shown by P2. At position P2, the removable locking pin 62 passes through hole 64*b* to fix the wheel in place. It will be noted that at position P1, the wheel is in contact with the material to be graded and/or the roadway. Whereas in position P2, the wheels, 38 and 42, are above the scraping surface 18 of the blade 12.

A chain 46 is attached to the blade 12 near the second end 22. The chain is attached via a chain attachment means 48. Basically, the chain attachment means is a bracket which is drilled through the blade with bolts on the back side. The chain 46 is then attached to the chain attachment means 48. The chain is of a slightly longer length than the first and second bar connection means. At an end opposite of the point where it connects to the chain attachment means 48, an adjustable chain loop 50 is defined. The adjustable chain loop 50 is created by taking a portion of the chain's 46 length and doubling it back. A mechanism is then inserted between two of the chain links to create a loop. This mechanism must be releasable (such as a bolt nut which can be tightened or loosened). The chain 46 is used to fix the angle of the blade relatively to the rear bumper of a vehicle. This principle is illustrated in FIG. 7. As shown, the adjustable chain loop 50 is looped around a second connection point 72. The releasable hitch 36 is attached to a first connection point 70. Both connection points are fixed on a bumper 68 of a vehicle 66. Thus the blade is attached to the vehicle 66 at a fixed angle. If the adjustable chain loop 50 is used to shorten the chain 46, the second end 22 of the blade 12 is moved closer towards the bumper 68 of the vehicle 66. Conversely, if the adjustable chain loop 50 is used to shorten the chain 46, the second end 22 is moved farther away from the bumper 68.

An alternative embodiment of the plow 10 is shown in FIGS. 8 through 10. The alternative embodiment in FIGS. 8 through 10 is simpler than the embodiment shown in FIGS. 1 through 7. It incorporates a reversible hitch 74. The reversible hitch 74 has an upper ball 76 and a lower ball 78. The reversible hitch may be either mounted to the bumper or may be a receiver-type hitch which is inserted into a receiver just below the bumper of the vehicle. The means of mounting the reversible hitch is immaterial to the invention. However, if a receiver-type mechanism is used, it is not necessary to have both an upper ball 76 and a lower ball 78. Where a receiver-type hitch is used, the receiver can be removed and turned 180° to rotate the ball to either an up position or a down position. An offset hitch plate 80 is designed to operate with the reversible hitch 74. The offset hitch plate maintains the first and second hitch bars is a position substantially parallel with the ground whether the releasable hitch 36 is engaged with the upper ball 76 or the lower ball 78. FIG. 8 shows the releasable hitch engaged with the upper ball 76. FIG. 9 shows the releasable hitch 36 engaged with the lower ball 78. This embodiment incorporates a fixed wheel 82. Whereas the other embodiment of the plow incorporated a wheel adjustment means 40 and 44. The alternative embodiment discussed now does not allow for adjustment of the wheels' 82 position. FIG. 10 is a partial cross-sectional detailed view of the reversible hitch 74, including the upper ball 76, the lower ball 78, and the releasable hitch 36, along with the offset hitch plate 80.

OPERATION OF APPARATUS

In operation, the plow 10 typically is attached to a ball-type connection means on a rear bumper of a vehicle. In a first embodiment of the invention, the user attaches the releasable hitch 36 to the ball. The user then adjusts the first and second wheel adjustment means, 40 and 42, to place the scraping surface 18 in operative contact with the bulk material to be plowed. The user accomplishes the adjustment by removing the removable locking pin 62, adjusting the sliding member to place the wheels in the desired position, then re-inserting the removable locking pin 62 into the appropriate adjusting hole 64. A user then adjusts the adjustable chain loop 50 to give the desired length of chain 46. The adjustable chain loop 50 is then placed on the second connection point 72 on the vehicle's bumper. Placing the adjustable chain loop 50 over the second connection point fixes the angle of the blade 12 with respect to the vehicle's bumper. This effect can be seen by referring to FIG. 7. If a user desired to move the second end 22 closer to the vehicle's bumper, he would simply increase the adjustable loop's diameter 50, decreasing the length of the chain 46, and moving the second end 22 closer to the vehicle's bumper. The procedure regarding the chain 46 is the same regardless of whether the first embodiment or the second embodiment of the invention is used.

In the second embodiment of the invention, a user will rotate the blade 12 so that the scraping surface 18 is in contact with the material to be plowed. This may be accomplished by several means. For example, a user can grasp the hitch plate lifting it upwardly and tilting the blade onto its back surface 16. Upon continuing to push on the hitch plate and/or the first and/or second hitch bars, 24 and 26, the plow 10 will rotate onto the scraping surface. The reverse process may be employed to rotate the plow 10 onto the fixed wheels. The releasable hitch 36 is then attached to the appropriate ball, either the upper ball 76 for plowing, or the lower ball 78 for towing the fixed wheels in contact with the roadway.

Having thus described the field of the invention, the prior, the attached drawings, the prior art, the summary of the invention, the drawings, and the detailed description of the preferred embodiments, I claim:

1. A floating snowplow trailer comprising:

a. a releaseable connection means for attaching the trailer to a vehicle;

b. a blade for scraping or moving a bulk material, such blade having a first end, a center point, a scraping surface and a second surface;

c. a frame having a first hitch bar attached to the blade via a first bar connection means adjacent to the first end, a second hitch bar attached to the blade by a second bar connection means near the center point, a cross bar disposed between the first hitch bar and the second hitch bar so as to provide additional stability thereto, and a hitch plate attached to a distal end of the first hitch bar and a distal end of the second hitch bar so as to create a triangular-shaped member comprised of a the first hitch bar, the second hitch bar and the blade;

d. wheels attached to the second surface, such wheels having two Z-shaped members attached to the second surface to define a channel, holes being defined in the Z-shaped members along a line, the holes being spaced apart, a sliding member adapted to be slidingly received within the channel defined by the Z-shaped members, side plates attached to the sliding member projecting outwardly and downwardly therefrom, and defining a hole therein for receiving an axle, a wheel rotatingly mounted upon an axle received within the hole defined in the side plates, and a removable locking pin adapted to be received within the holes defined by the Z-shaped members in the sliding member, whereby the sliding member can be moved upwardly or downwardly to cause the wheel to either be in contact with the roadway or to move upwardly so that the scraping surface is, instead of the wheel, in contact with the roadway;

e. an angle adjustment means for adjusting an angle of the blade relative to the bumper of the vehicle to which it is attached.

* * * * *